United States Patent [19]

Difflipp et al.

[11] Patent Number: 4,515,078

[45] Date of Patent: May 7, 1985

[54] DOCTOR BLADE DRIVE

[75] Inventors: Kurt Difflipp, Dietzenbach; Johannes Wanke, Offenbach am Main, both of Fed. Rep. of Germany

[73] Assignee: M.A.N.-Roland Druckmaschinen AG, Fed. Rep. of Germany

[21] Appl. No.: 500,272

[22] Filed: Jun. 2, 1983

[30] Foreign Application Priority Data

Jun. 3, 1982 [DE] Fed. Rep. of Germany ..... 3220845

[51] Int. Cl.[3] ..... B41F 9/10

[52] U.S. Cl. ..... 101/157; 101/DIG. 14

[58] Field of Search ..... 101/D14, 155–158, 101/160–162, 167, 168, 169, 169.1, 348, 349, 363

[56] References Cited

U.S. PATENT DOCUMENTS

| | | | |
|---|---|---|---|
| 2,447,090 | 8/1948 | Pollock | 101/169 |
| 2,506,778 | 5/1950 | Crafts | 101/348 |
| 3,491,686 | 1/1970 | Zurick | 101/352 |
| 3,636,866 | 1/1972 | Stommel | 101/22 |
| 3,911,812 | 10/1975 | Flynn | 101/1 |
| 4,004,511 | 1/1977 | de Groot | 101/334 |
| 4,398,463 | 8/1983 | Yessler | 101/157 |

FOREIGN PATENT DOCUMENTS

| | | | |
|---|---|---|---|
| 293999 | 12/1914 | Fed. Rep. of Germany | 101/157 |
| 535860 | 10/1931 | Fed. Rep. of Germany | 101/169 |
| 712024 | 3/1939 | Fed. Rep. of Germany | 101/157 |
| 706619 | 1/1940 | Fed. Rep. of Germany | 101/155 |
| 756188 | 10/1940 | Fed. Rep. of Germany | 101/157 |
| 1038066 | 9/1958 | Fed. Rep. of Germany | 101/157 |
| 458016 | 12/1936 | United Kingdom | 101/157 |

*Primary Examiner*—Clyde Coughenour
*Assistant Examiner*—William L. Klima
*Attorney, Agent, or Firm*—Leydig, Voit, Osann, Mayer & Holt, Ltd.

[57] ABSTRACT

An arrangement for longitudinally oscillating a doctor blade relative to the form cylinder in a printing press. The arrangement includes a double armed rocker having one arm coupled to the doctor blade and the other arm coupled to a hydraulic cylinder. The rocker is mounted on a central eccentric portion of a pivot shaft through a one way idler bearing and the pivot shaft is rotatably supported in a counteracting one way idler bearing. By oscillating the rocker, through sequential operation of the double acting cylinder, the pivot axis of the rocker is continuously displaced, causing the points of reversal of doctor blade movement to be continuously varied independently of the press operation, while maintaining a uniform stroke. In the illustrated embodiment, a pneumatic control is provided for controlling operation of the hydraulic cylinder, and thus the rocker arm and doctor blade movement.

12 Claims, 3 Drawing Figures

DOCTOR BLADE DRIVE

DESCRIPTION OF THE INVENTION

The present invention relates generally to doctor blades for printing presses, and more particularly, to arrangements for oscillating a doctor blade in longitudinal directions on the form cylinder of a printing press.

Such arrangements are required to generate movement of the doctor blade on the form cylinder of a gravure press, for example, so that removal of ink is assisted and the blade is prevented frm running into the form, which can cause so called doctor blade streaks that can destroy or render unusable the printing form. Heretofore, the control and drive for such doctor blade oscillating means commonly has been hydraulically actuated since mechanically generated oscillating movements are normally sinusoidal, and thus, cause the doctor blade to have a dwell point upon reversal of movement as well as causing the speed of the doctor blade to vary during movement. Such hydraulically actuated doctor blade oscillating means, however, also have had various drawbacks.

British Patent Specification No. 588,057, for example, discloses a hydraulically operated doctor blade oscillating arrangement in which a control cam driven by the printing press moves a hydraulic valve for a hydraulic cylinder, which superimposes additional movement to the doctor blade to that determined by the control cam. The reversal points of the doctor blade are displaced at a frequency determined by the speed of the control cam, but are repeated for each revolution of the control cam. Hence, the reversal points of movement are always fixed at defined positions. The doctor blade stroke can be changed only by elaborate means via a modified controlled cam.

German Pat. No. 1,038,066 describes a hydraulic doctor blade drive in which valves for controlling reversing doctor blade movement are actuated by a cam. The doctor blade stroke in this case is varied continuously, while movement of the reversal points are changed. The effect of the doctor blade, therefore, is non-uniform since the lateral speed of the doctor blade on the cylinder is continuously changing. The control system also is relatively complex, dependent upon the machine drive, and movement of the controlled valves is unchangeable. A further disadvantage of each of the foregoing arrangements is that they require a hydraulic drive, which may not be provided in all printing presses.

It is an object of the present invention to provide an improved means for oscillating a printing press doctor blade which is adapted to continuously displace the reversal points of doctor blade movement between a theoretically infinite number of positions, while maintaining the stroke of the doctor blade movement constant.

Another object is to provide a doctor blade oscillating means as characterized above that is operated independent of the machine cycle and selectively controllable within limits.

A further object is to provide such a doctor blade oscillating means which can be pneumatically operated.

Yet another object is to provide a doctor blade oscillating means of the foregoing type in which the speed profile of the doctor blade in relation to the cylinder remains constant during operation, and thus the effect of the doctor blade is constant.

Still a further object is to provide a doctor blade oscillating means of the above kind in which the stroke of the doctor blade can be selectively adjusted independently of the machine cycle so as to more reliably prevent doctor blade streaks.

Other objects and advantages of the invention will become apparent upon reading the following detailed description and upon reference to the drawings in which.

Figure 1:
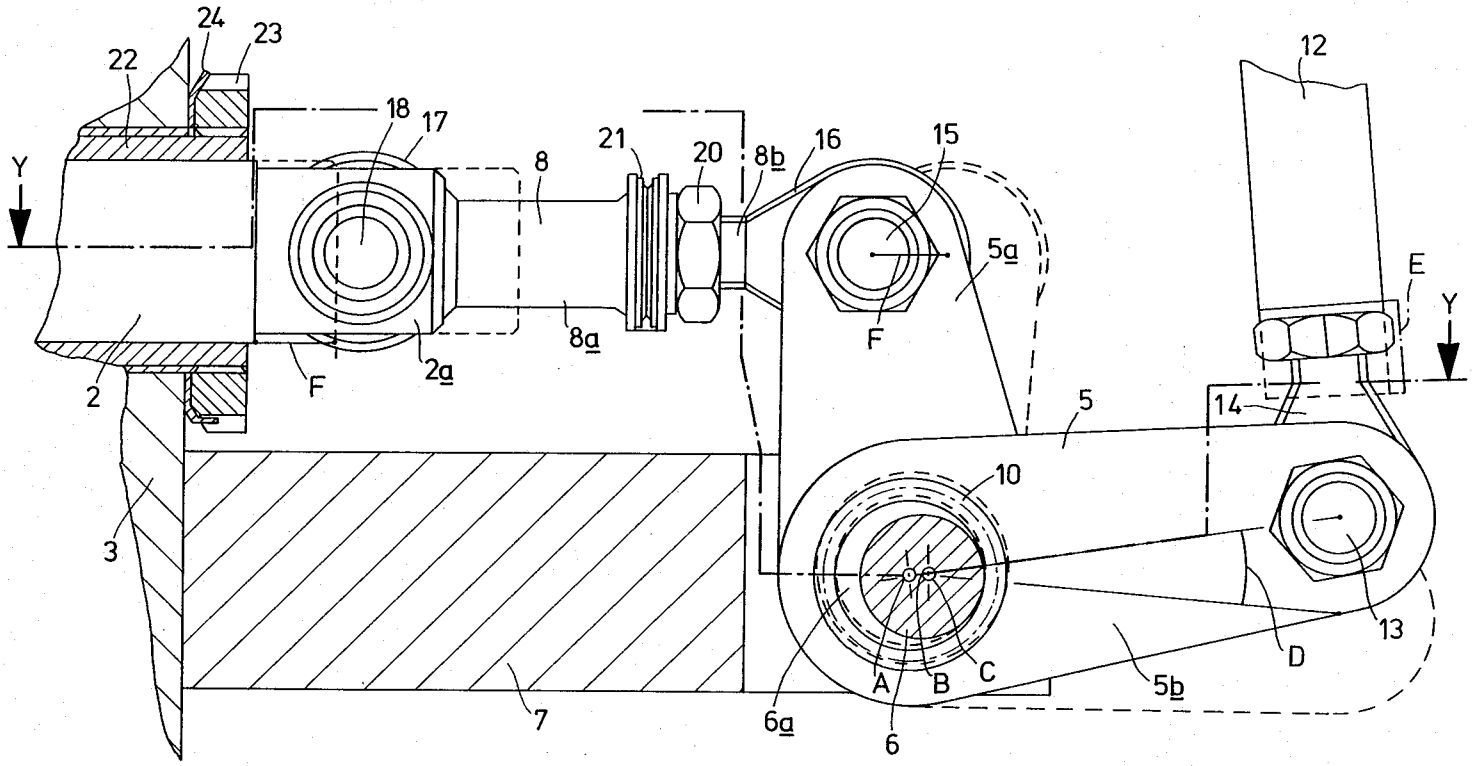
FIG. 1 is a side view, in partial section, of a doctor blade oscillating mechanism embodying the invention, taking in the plane of line X—X in FIG. 2.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Figure 3:
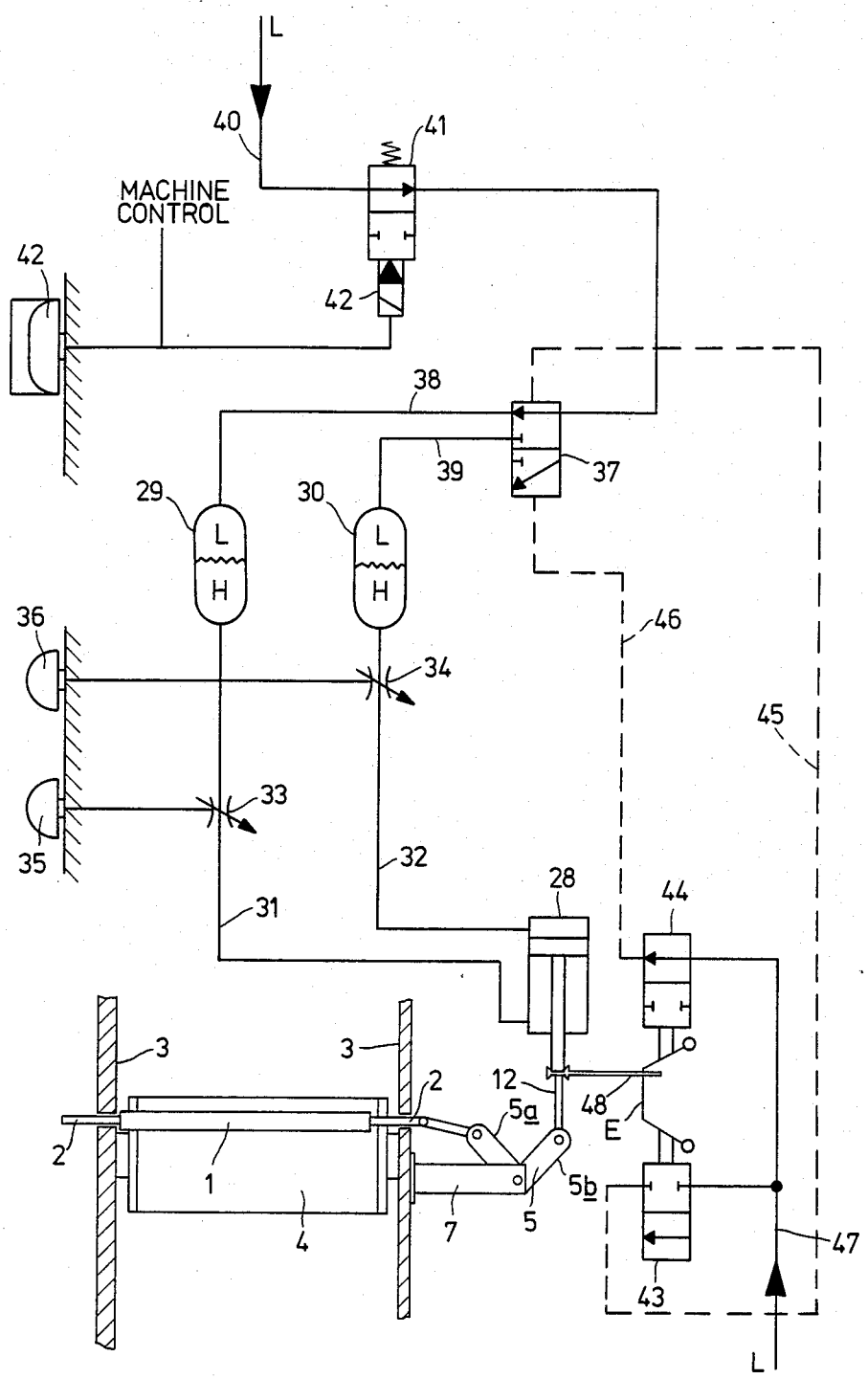
FIG. 3 is a schematic of a form cylinder and a doctor blade having a drive control in accordance the present invention.

Referring now more particularly to the drawings, there is shown diagrammatically in FIG. 3 a doctor blade 1 supported on shafts 2, which in turn are supported for relative longitudinal movement in a frame 3 of a printing press immediately adjacent a form cylinder 4. For longitudinally moving the doctor blade 1, the shaft 2 at one end of the doctor blade is connected to one arm 5*a* of double arm rocker 5 by a coupling 8 (FIG. 1). The rocker 5 is mounted on a shaft 6 in turn mounted in a forked holder 7 of the machine frame 3 and has its opposite arm 5*b* connected to a piston rod 12 of a hydraulic cylinder 28.

Figure 2:
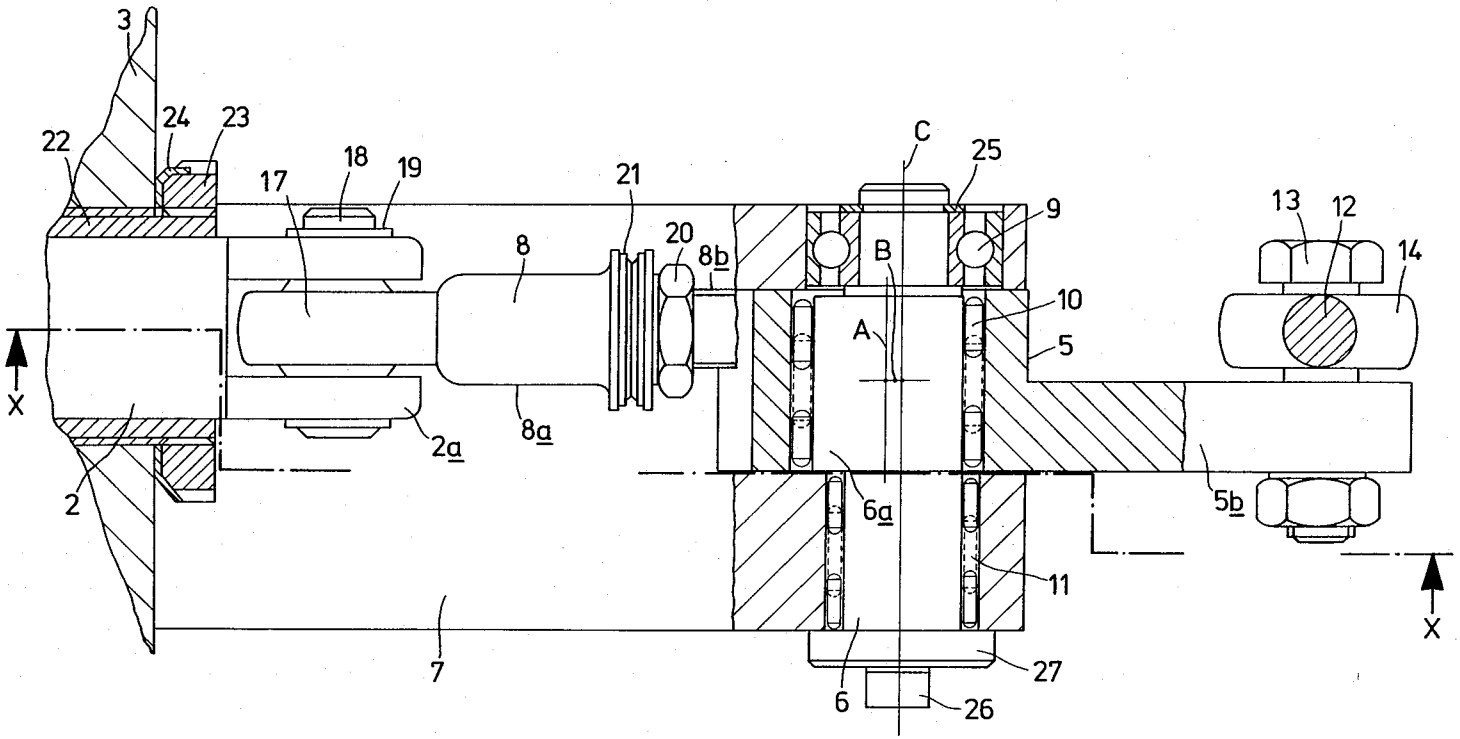
FIG. 2 is a horizontal section taken in the frame of line Y—Y in FIG. 1.

For permitting relative pivotable movement between the rocker 5, piston rod 12, and coupling 8, as best shown in FIGS. 1 and 2, the piston rod 12 carries a bearing member 14 at its outermost end which is connected to the arm 5*b* of the rocker 5 by a bolt 13 extending through the bearing 14 and rocker arm 5*b*. The other arm 5*a* of the rocker 5 is connected to a bearing member 16 on the end of the coupling 8 by a bolt 15. The opposite end of the coupling 8 similarly is formed with a bearing 17 which is connected to a forked end 2*a* of the doctor blade shaft 2 by a bolt 18. The bolt 18 in this instance is secured by a clip ring 19.

To permit rotation of the doctor blade 1 to a position away from the cylinder 4 for removal and/or replacement, the coupling 8 has a two-part construction, consisting of the shank 8*a* having a threaded hole and shank 8*b* having a screw formed at the end thereof so as to permit threaded assembly and engagement of the two parts, which are secured in assembled position by a nut 20 and a set of cup springs 21 which prevent play and loosening of the two parts. In the event the doctor blade must be changed, the coupling 8 permits rotation of the doctor blade and coupling part 8*a* secured thereto relative to the coupling part 8*b* and rocker 5, thereby permitting the doctor blade to be swung away from the cylinder 4 about the shaft 2. To permit such rotational movement of the shaft 2, as well as oscillating longitudinal movement as will be described, the shaft 2 is mounted in a bushing 22 in the frame 3, the bushing being secured to the frame 3 by a nut 23 and a lock plate 24. From the foregoing, it can be seen that pivotable movement of the rocker 5 effected by the extention and retraction of the piston rod 12 will cause longitudinal movement of the doctor blade 1 relative to the cylinder 4.

In accordance with the invention, the rocker has a swivel axis that is continuously displacable independently of the press operation for constantly varying the reversal points of the doctor blade movement. To this end, the rocker shaft 6 is mounted for pivotable movement in the fork of the holder 7 by a one way idling bearing 11, and the shaft 6 is formed with a central eccentric portion 6*a* upon which the rocker 5 is mounted through a one way idling bearing 10 which operates in counteracting fashion to the one way bearing 11. In the illustrated embodiment, one end of the shaft 6 is carried by the one way bearing 11 and the other end is supported in the fork holder 7 by a ball bearing 9. The ball bearing 9 is secured on the shaft 6 by a retainer ring 25, and the shaft 6 is supported in the fork holder 7 on the opposite side by a locking plate 27 secured in place by a screw 26, so that the shaft 6 is axially retained by the locking plate 27 and the eccentric central section 6*a* of the shaft.

The one way idling bearings 10, 11 may be of any known type, which permit relative rotational movement of the two members therebetween in one direction while locking relative rotational movement in an opposite direction. It will be understood that a ratchet or other similar means could be alternatively used. In the illustrative embodiment, the idling bearings 10, 11 are counteracting such that when the rocker 5 is rotated in one direction, the idling bearing 10 locks between the rocker 5 and shaft 6, whereas the idling bearing 11 allows the shaft 6 to move freely relative to the holder 7. During reverse movement of the rocker 5, the idling bearing 11 locks the shaft 6 to the holder 7, while the idling bearing 10 permits the rocker 5 to turn freely on the shaft 6. Since the swivel axis A of the rocker on the eccentric shaft section 6*a* has an eccentricity B with respect to the axis C of the shaft rotation relative to the holder 7, the axis of rotation is continuously displaced during such oscillating movements, causing changes in the points of reversal of the oscillating movement of the doctor blade 1 in relation to the form cylinder 4. Such doctor blade movement depends on the oscillating angle D of the rocker 5 and this in turn on the piston stroke E, which again corresponds to the doctor blade stroke F. Hence, by rotation of the shaft 6 the position of the doctor blade stroke F or reversal points of the oscillating movement of the doctor blade 1 on the cylinder 4 is always varried according to the set piston stroke E, whereas the piston stroke E and thus the doctor blade stroke F remain constant.

For selectively controlling operation of the hydraulic cylinder 28 (FIG. 3), and thus the extension and retraction of the cylinder rod 12, in the illustrated embodiment, hydropneumatic accumulators 29, 30 are provided in hydraulic lines 31, 32 coupled to opposite ends of the cylinder 28. Throttle valves 33, 34, which can be regulated by outside controls 35, 36 to vary the throughflow of the hydraulic fluid H, also are incorporated in the hydraulic lines 31, 32. The accumulators 29, 30 in this instance are half-filled with hydraulic fluid H. Above the fluid level they are supplied with compressed air L by a control valve 37 via lines 38, 39. The control valve 37 is supplied with compressed air L by a feed line 40 via a solenoid shut-off valve 41, which is actuated by a switch 42 or from the machine control system. The control valve 37 is switched by pilot valves 43, 44, which are supplied with air 47 via control lines 45, 46. The pilot valves 43, 44 are adjustably arranged on both sides of a stop 48, which is secured to the piston rod 12. It will be understood that the distance of the pilot valves 43, 44 and thus the piston stroke E of the piston rod 12 can be suitably adjusted.

In a typical cycle of operation starting from the condition in FIG. 3, when the compressed air L is switched on by switch 42 the piston rod 12 of the hydraulic cylinder 28 is fully extended until the stop 48 actuates the valve 43, which in turn actuates the control valve 37 via the control line 45. Compressed air is then supplied to the accumulator 29. Hydraulic fluid H is thus forced through the hydraulic line 31 and the throttle valve 33 into the hydraulic cyliner 28. The throughflow in the throttle valve 33 is adjusted via the control element 35. This also determines the speed of the movement of the piston rod 12, rocker 5, coupling 8 and doctor blade 1. When the stop 48 is retracted to the pilot valve 44, the control valve 37 is reversed via the control line 46 and compressed air L diverted to the accumulater 30, whereupon the air pressure forces the hydraulic fluid H through the hydraulic line 32 and the throttle valve 34 into the hydraulic cylinder 28. The piston rod 12 is thus moved downwardly again and pushes the doctor blade 1 back via the rocker arm 5 and coupling 8. The length and speed of the movement of the doctor blade 1 can thus be easily adjusted via the position of the pilot valves 43, 44 and setting of the throttle valves 33, 34.

It will be appreciated that the movement of the shaft 6 as a function of the movement of the piston rod 12 is determined by the geometry of the rocker 5, i.e., the length of the arm sections of the rocker 5. In operation, the rocker is pivoted in identical angular steps with the same piston stroke E. With suitable selection of the piston stroke E the oscillating angle D will not or only rarely lead to coincidence of reversal points of the doctor blade stroke F. Theoretically the reversal points of the doctor blade stroke F can be displaced to an infinite number of points within the maximum doctor blade stroke F. The doctor blade stroke F is displaced in relation to the form cylinder 4 by the eccentric movement of the shaft 6, which moves the position of the reversal points to new positions on the sinusoidal eccentric movement according to the ratio of the oscillating angle D to the full cycle.

From the foregoing, it can be seen that doctor blade oscillating movement is generated by the rocker arm and the swival axis thereof can be continuously displaced independently of the machine operation. It is thus possible to keep the doctor blade stroke constant in a relatively simple way, while continously displacing the reversal points of the movement to a theoretically infinite number of positions. The speed profile of the doctor blade in relation to the cylinder remains constant during the operation, as does the effect of the blade on the cylinder. By controlling operation of the hydraulic cylinder by means of a pneumatic control, the system also is readily adaptable on machines which are supplied only with compressed air and electrical means. The stroke on the doctor blade can be easily adjusted independently of the machine cycle with the result that doctor blade can be reliably controlled to prevent undesirable streaking. While the invention has been described in connection with pneumatically controlled hydraulic cylinder means for actuating the rocker, it will be appreciated that other means, including cam means, could be employed.

What is claimed is:

1. In a printing press having a form cylinder and a doctor blade, means for mounting the doctor blade for longitudinal oscillatory movement relative to the form cylinder, and means for generating oscillating movement of said doctor blade wherein the improvement comprises:

said oscillating movement generating means includes a pivotably mounted rocker, means coupling the rocker to the doctor blade, means for sequentially pivoting said rocker in opposite directions to effect oscillation longitudinal movement of said doctor blade, and means for continuously displacing the pivot axis of said rocker independently of the press operation for continuously varying the points of reversal of the doctor blade oscillating movement, said means for continuously displacing the rocker pivot axis including a shaft having an eccentric section, first one way idler bearing means for supporting said rocker on said eccentric shaft portion for rotation about an eccentric axis thereof, means including second one way idler bearing means for supporting said shaft for rotational movement about a pivot axis of said shaft, said first bearing means being operable to permit rotational movement of said rocker relative to said eccentric shaft portion in one direction while said second bearing means blocks rotational movement of said shaft in such direction about said pivot axis, and said second bearing means being operable to permit rotational movement of said shaft about said pivot axis in an opposite direction while said first bearing means blocks rotational movement of said rocker relative to said eccentric shaft portion in such direction.

2. In the improvement of claim 1 in which said rocker pivoting means includes hydraulically actuated means, and pneumatic means for controlling the operation of said hydraulic means.

3. In the improvement of claim 1 in which said eccentric shaft portion is formed centrally on said shaft, and said shaft has at least one end supported by said second one way bearing means.

4. In the improvement of claim 1 in which said rocker is a pivotable lever.

5. In the improvement of claim 1 in which rocker pivoting means includes a hydraulic cylinder, said rocker being a double armed lever, first coupling means connecting one arm of said rocker to said hydraulic cylinder, and second coupling means connecting the other arm of said lever to said doctor blade.

6. In the improvement of claim 5 in which said second coupling means is operable to permit rotation of said doctor blade with respect to said form cylinder to facilitate removal and replacement of said doctor blade.

7. In the improvement of claim 2 in which said hydraulically actuated means includes a double action hydraulic cylinder, and throttling means for controlling the flow of hydraulic fluid to said cylinder for controlling the speed of actuation thereof, and thus, the speed of oscillating movement of said doctor blade.

8. In the improvement of claim 7 in which said throttling means are selectively adjustable.

9. In the improvement of claim 8 including two hydropneumatic accumulators each being coupled to opposite ends of said hydraulic cylinder by respective hydraulic supply lines, and throttling valves interposed in said hydraulic supply lines.

10. In the improvement of claim 2 in which said hydraulically actuated means includes a double action hydraulic cylinder, and said pneumatic means includes hydropneumatic accumulators operatively coupled to said hydraulic cylinder, a pressurized air supply, and air control valve means actuated in response to the condition of said hydraulic cylinder for supplying air to said hydropneumatic accumulators for operating said hydraulic cylinder.

11. In the improvement of claim 10 in which said hydraulic cylinder has an extensible and retractible cylinder rod, respective pneumatic pilot valves for sensing the extended and retracted conditions of said cylinder rod, and said air control valve means being actuated in response to actuation of respective of said pilot valves.

12. In the improvement of claim 11 including hydraulic throttling valve means interposed between said hydropneumatic accumulators and said hydraulic cylinder for controlling the speed of movement of said cylinder rod and the speed of movement of the doctor blade.

* * * * *